US009298123B2

(12) United States Patent
Murakami et al.

(10) Patent No.: US 9,298,123 B2
(45) Date of Patent: Mar. 29, 2016

(54) OPTICAL WRITING CONTROL DEVICE, IMAGE FORMING APPARATUS, AND METHOD FOR CONTROLLING OPTICAL WRITING DEVICE

(71) Applicants: Masatoshi Murakami, Osaka (JP); Tatsuya Miyadera, Kanagawa (JP)

(72) Inventors: Masatoshi Murakami, Osaka (JP); Tatsuya Miyadera, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/535,422

(22) Filed: Nov. 7, 2014

(65) Prior Publication Data

US 2015/0139702 A1 May 21, 2015

(30) Foreign Application Priority Data

Nov. 18, 2013 (JP) ..... 2013-237940

(51) Int. Cl.

| | |
|---|---|
| ***G03G 15/14*** | (2006.01) |
| ***G03G 15/043*** | (2006.01) |
| ***G03G 15/00*** | (2006.01) |

(52) U.S. Cl.

CPC ..... *G03G 15/043* (2013.01); *G03G 15/5041* (2013.01)

(58) Field of Classification Search

CPC ..... G03G 15/5025; G03G 15/5041

See application file for complete search history.

(56) References Cited

U.S. PATENT DOCUMENTS

| | | | | |
|---|---|---|---|---|
| 8,036,553 | B2 * | 10/2011 | Endou et al. | 399/49 |
| 2009/0074476 | A1 | 3/2009 | Miyadera | |
| 2012/0301168 | A1 * | 11/2012 | Kobayashi et al. | 399/66 |
| 2013/0242318 | A1 * | 9/2013 | Yamaguchi et al. | 358/1.9 |
| 2014/0152754 | A1 | 6/2014 | Murakami et al. | |
| 2015/0261118 | A1 | 9/2015 | Murakami et al. | |

FOREIGN PATENT DOCUMENTS

| | | | |
|---|---|---|---|
| JP | 2009-069767 | | 4/2009 |
| JP | 2013195691 | A * | 9/2013 |
| JP | 2014-109719 | | 6/2014 |
| JP | 2014-167516 | | 9/2014 |
| JP | 2015-55784 | | 3/2015 |
| JP | 2015-59996 | | 3/2015 |
| JP | 2015-193235 | | 11/2015 |

* cited by examiner

*Primary Examiner* — Clayton E Laballe
*Assistant Examiner* — Leon W Rhodes, Jr.
(74) *Attorney, Agent, or Firm* — Cooper & Dunham LLP

(57) ABSTRACT

The device comprises: a light emission control unit forming an latent image on a photoconductor; a correction value calculation unit calculating a correction pattern for correcting a transfer position where a developer image of the latent image transfers to a conveying member; and an angle adjustment processing unit that determines an angle of an oblique line pattern included in the correction pattern on the basis of a detection signal of an angle adjustment pattern including a plurality of continuous oblique line patterns, wherein the light emission control unit controls a light to emit so that a plurality of oblique line patterns having different inclinations relative to a conveying direction of the conveying member are continuously formed to draw the angle adjustment pattern, and controls the light to emit so that an oblique line pattern having the determined angle is formed in the correction pattern to draw the correction pattern.

9 Claims, 16 Drawing Sheets

Fig. 14 (a)
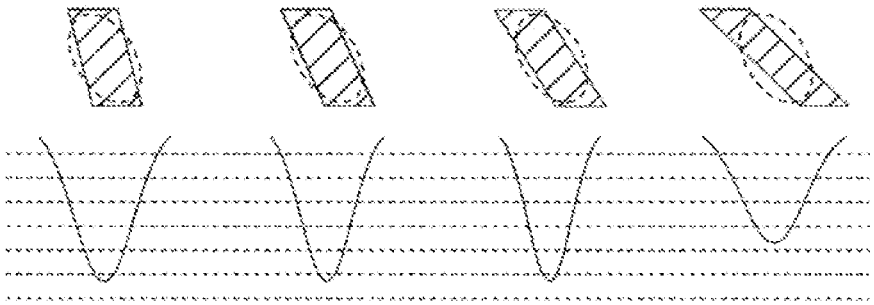
Fig. 14 (b)
Fig. 14 (c)
Fig. 14 (d)
Fig. 14 (e)
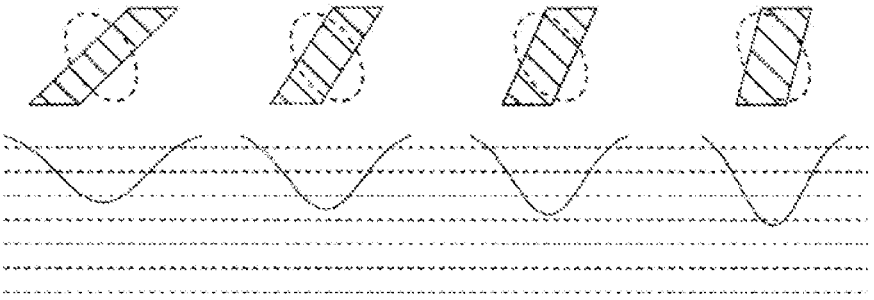
Fig. 14 (f)
Fig. 14 (g)
Fig. 14 (h)

OPTICAL WRITING CONTROL DEVICE, IMAGE FORMING APPARATUS, AND METHOD FOR CONTROLLING OPTICAL WRITING DEVICE

CROSS-REFERENCE TO RELATED APPLICATIONS

The present application claims priority to and incorporates by reference the entire contents of Japanese Patent Application No. 2013-237940 filed in Japan on Nov. 18, 2013.

BACKGROUND OF THE INVENTION

1. Field of the Invention

The present invention relates an optical writing control device, an image forming apparatus, and a method for controlling an optical writing device, and particularly to the configuration of a pattern that is drawn for correcting a drawing position of an image.

2. Description of the Related Art

In recent years, digitization of information has been promoted. Therefore, image processing apparatuses such as a printer and a facsimile used for outputting digitized information and a scanner used for digitizing documents are essential. Such an image processing apparatus is often provided with an imaging function, an image forming function, a communication function and the like and thereby configured as a multifunction peripheral that can be used as a printer, a facsimile, a scanner and a copier.

Among these image processing apparatuses, an electrophotographic image forming apparatus is widely used as an image forming apparatus that is used for outputting digitized documents. In an electrophotographic image forming apparatus, a photoconductor is exposed to light to form an electrostatic latent image, the electrostatic latent image is developed using a developer such as toner to form a toner image, and the toner image is transferred onto a sheet to perform sheet-output.

In such an electrophotographic image forming apparatus, adjustment for forming an image within an appropriate area on a sheet is performed by matching timing of exposing a photoconductor to light to draw an electrostatic latent image with timing of conveying the sheet. Further, in a tandem type image forming apparatus which forms a color image using a plurality of photoconductors of different colors, adjustment of exposure timing in each of the photoconductors of the respective colors is performed so that images developed in the photoconductors of the respective colors are accurately superimposed. Hereinbelow, these adjustment processes are collectively referred to as position shift correction.

As a specific method for achieving the position shift correction as described above, there are a mechanical adjustment method that adjusts the arrangement relationship between a light source that exposes a photoconductor to light and the photoconductor and a method using image processing that adjusts an image to be output depending on position shift so that the image is finally formed at a preferred position. In the method using image processing, a correction pattern is drawn and read, and correction is performed on the basis of the difference between timing that is determined according to the design and timing when the pattern is actually read so that an image is formed at a desired position (see Japanese Laid-open Patent Publication No. 2009-069767, for example).

When using the position shift correction method using image processing as described above, in order to correct position shift in a main-scanning direction, a pattern that is inclined relative to a sub-scanning direction is drawn. Japanese Patent Application Publication No. 2009-069767 discloses an oblique line pattern having an inclined line shape and a triangular pattern as examples of such a pattern having inclination. Among these patterns, in order to reduce toner consumption, it is preferred to use the oblique line pattern.

On the other hand, a pattern that is drawn in the position shift correction using image processing as described above is detected by receiving reflected light of a beam emitted onto a surface on which the pattern is drawn. That is, when the position shift correction pattern covers a beam spot, reflected light of the beam changes. The pattern is detected by detecting the change by a light receiving unit.

Therefore, in order to accurately detect the position of a pattern, it is preferred that a change in the amount of received light when the pattern reaches a beam spot be steep. Therefore, it is required to increase the maximum value of the area of a range of covering the beam spot with the pattern as far as possible.

A spot of a beam that is emitted from a light source for detecting a correction pattern has a generally perfect circular shape. However, because the axis of the beam is inclined relative to an irradiation surface, the beam spot projected on the irradiation surface is formed into an elliptical shape corresponding to the inclination of the axis of the beam. Further, there is tolerance in an attached state of a sensor for detecting the correction pattern. Therefore, the angle in the long-axis direction of the ellipse differs between apparatuses. FIG. 19(*a*) is a diagram illustrating an example of such a beam spot.

As described above, in order to increase the maximum value of the area of a range of covering a beam spot with a pattern as far as possible, the pattern is formed so as to cover a wide area of the beam spot on the irradiation surface. On the other hand, when an oblique line pattern is used as described above and the inclination of the oblique line pattern is deviated from the inclination in the long-axis direction of a beam spot, the range of covering the beam spot with the pattern is made narrow.

FIGS. 19(*b*) and 19(*c*) are diagrams each illustrating an example of the range of covering a beam spot with an oblique line pattern. When the inclination angle of an oblique line pattern and the inclination angle in the long-axis direction of a beam spot are close to each other, as illustrated in FIG. 19(*b*), the oblique line pattern covers a wide area of the beam spot. On the other hand, when the inclination angle of an oblique line pattern and the inclination angle in the long-axis direction of a beam spot largely differ from each other, as illustrated in FIG. 19(*c*), the range of covering the beam spot with the oblique line pattern is narrow.

Also in the state illustrated in FIG. 19(*c*), in order to cover a wide area of the beam spot with the oblique line pattern, the width of the oblique line pattern is made wide. However, in this case, toner consumption disadvantageously increases.

In view of the above circumstances, there is a need to achieve reduction in toner consumption associated with drawing of a correction pattern for correcting an image forming position and improvement in the accuracy of pattern detection.

SUMMARY OF THE INVENTION

It is an object of the present invention to at least partially solve the problems in the conventional technology.

According to the present invention, there is provided an optical writing control device that controls a light source that exposes a photoconductor to light to form an electrostatic latent image on the photoconductor, the optical writing control device comprising: a light emission control unit that controls the light source to emit light to expose the photoconductor to light; a detection signal acquisition unit that acquires a detection signal from a sensor that detects an image obtained by developing an electrostatic latent image formed on the photoconductor on a conveying member onto which the image is transferred and conveyed; a correction value calculation unit that calculates, on the basis of a detection signal obtained by detecting a correction pattern by the sensor, the correction pattern being used for correcting a transfer position at which a developer image obtained by developing an electrostatic latent image formed on the photoconductor is transferred onto the conveying member and including an oblique line pattern inclined relative to a conveying direction of the conveying member, a correction value for correcting the transfer position; and an angle adjustment processing unit that determines an angle of the oblique line pattern included in the correction pattern on the basis of a detection signal obtained by detecting an angle adjustment pattern by the sensor, the angle adjustment pattern including a plurality of continuous oblique line patterns having different inclinations relative to the conveying direction, wherein the light emission control unit controls the light source to emit light so that a plurality of oblique line patterns having different inclinations relative to the conveying direction are continuously formed to draw the angle adjustment pattern, and controls the light source to emit light so that an oblique line pattern having the determined angle is formed in the correction pattern to draw the correction pattern.

The present invention also provides an image forming apparatus comprising the above-mentioned optical writing control device.

The present invention also provides a method for controlling an optical writing device that controls a light source that exposes a photoconductor to light to form an electrostatic latent image on the photoconductor, the method comprising the steps of: controlling the light source to emit light to expose the photoconductor to light; acquiring a detection signal from a sensor that detects an image obtained by developing an electrostatic latent image formed on the photoconductor on a conveying member onto which the image is transferred and conveyed; calculating, on the basis of a detection signal obtained by detecting a correction pattern by the sensor, the correction pattern being used for correcting a transfer position at which a developer image obtained by developing an electrostatic latent image formed on the photoconductor is transferred onto the conveying member and including an oblique line pattern that has a width corresponding to a detection range of the sensor in a main-scanning direction and is inclined relative to a conveying direction of the conveying member, a correction value for correcting the transfer position; and determining an angle of an oblique line pattern included in the correction pattern on the basis of a detection signal obtained by detecting the angle adjustment pattern by the sensor, the angle adjustment pattern including a plurality of continuous oblique line patterns having different inclinations relative to the conveying direction.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 14*a*-14*h* are diagrams each illustrating an example of a detection signal with respect to an oblique line pattern according to the embodiment of the present invention;

DETAILED DESCRIPTION OF THE PREFERRED EMBODIMENTS

Hereinbelow, an embodiment of the present invention will be described in detail with reference to the drawings. In the present embodiment, a multifunction peripheral (MFP) is described as an example of an image forming apparatus. The image forming apparatus according to the present embodiment is an electrophotographic image forming apparatus and characterized in optimization of the angle of an oblique line pattern having an angle relative to a conveying direction among patterns that are drawn in a position shift correction operation for correcting exposure timing of a photoconductor.

Figure 1:
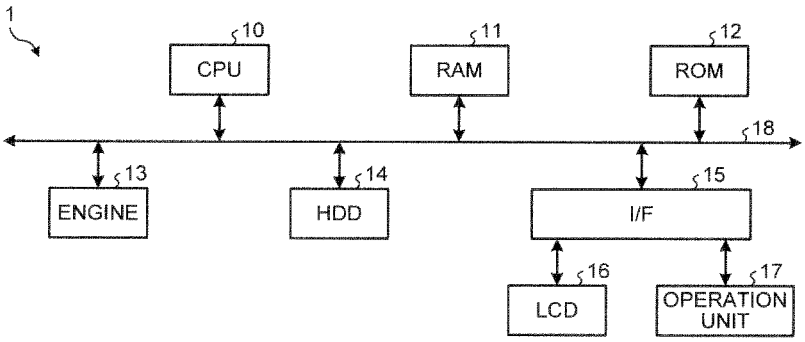
FIG. 1 is a block diagram illustrating the hardware configuration of an image forming apparatus according to an embodiment of the present invention.

FIG. 1 is a block diagram illustrating the hardware configuration of an image forming apparatus 1 according to the present embodiment. As illustrated in FIG. 1, the image forming apparatus 1 according to the present embodiment includes an engine that performs image formation in addition to the same configuration as a general server or information processing terminal such as a personal computer (PC). Specifically, the image forming apparatus 1 according to the present embodiment includes a CPU (central processing unit) 10, a RAM (random access memory) 11, a ROM (read-only memory) 12, an engine 13, an HDD (hard disk drive) 14, and an I/F 15 all of which are connected via a bus 18. An LCD (liquid crystal display) 16 and an operation unit 17 are connected to the I/F 15.

The CPU 10 is an arithmetic unit and controls an operation of the entire image forming apparatus 1. The RAM 11 is a volatile storage medium that can read and write information at a high speed and is used as a working area when the CPU 10 processes information. The ROM 12 is a read-only non-volatile storage medium and stores therein a program such as firmware. The engine 13 is a mechanism that actually performs image formation in the image forming apparatus 1.

The HDD 14 is a non-volatile storage medium that can read and write information and stores therein an operating system (OS), various control programs, various application programs, and the like. The I/F 15 connects the bus 18 to various hardware and networks and the like and controls the connection. The LCD 16 is a visual user interface that is provided to allow a user to confirm a state of the image forming apparatus 1. The operation unit 17 is a user interface, such as a keyboard and a mouse, that is provided to allow a user to input information to the image forming apparatus 1.

In such a hardware configuration, programs stored in the ROM 12, the HDD 14, or a recording medium such as an optical disk (not illustrated) are read to the RAM 11, and the CPU 10 performs an arithmetic operation in accordance with these programs, thereby configuring a software control unit. A combination of the software control unit configured in this manner and the hardware constitutes a functional block that implements functions of the image forming apparatus 1 according to the present embodiment.

Figure 2:
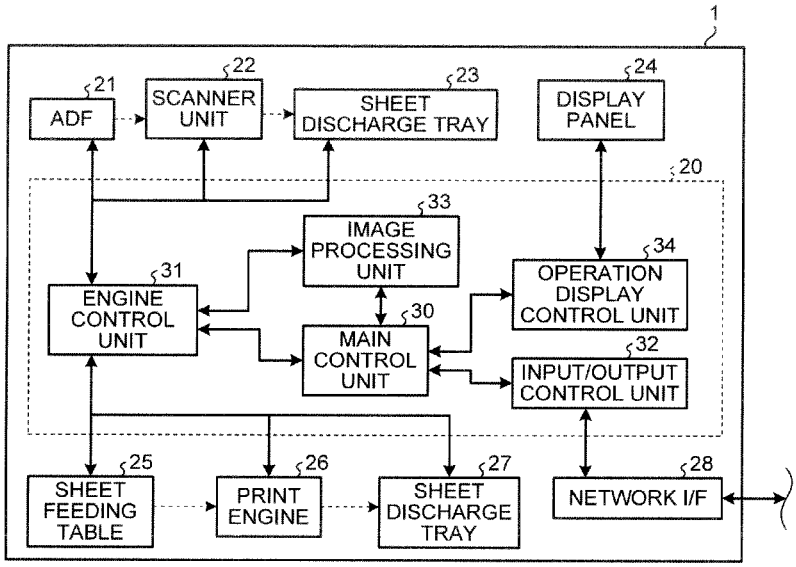
FIG. 2 is a diagram illustrating the functional configuration of the image forming apparatus according to the embodiment of the present invention.

Next, the functional configuration of the image forming apparatus 1 according to the present embodiment will be described with reference to FIG. 2. FIG. 2 is a block diagram illustrating the functional configuration of the image forming apparatus 1 according to the present embodiment. As illustrated in FIG. 2, the image forming apparatus 1 according to the present invention includes a controller 20, an ADF (auto document feeder) 21, a scanner unit 22, a sheet discharge tray 23, a display panel 24, a sheet feeding table 25, a print engine 26, a sheet discharge tray 27, and a network I/F 28.

The controller 20 includes a main control unit 30, an engine control unit 31, an input/output control unit 32, an image processing unit 33, and an operation display control unit 34. As illustrated in FIG. 2, the image forming apparatus 1 according to the present embodiment is configured as a multifunction peripheral that includes the scanner unit 22 and the print engine 26. In FIG. 2, electrical connections are indicated by solid line arrows, and the flow of a sheet is indicated by broken line arrows.

The display panel 24 is an output interface that visually displays a state of the image forming apparatus 1 as well as an input interface (operation unit) used as a touch panel when a user directly operates the image forming apparatus 1 or inputs information to the image forming apparatus 1. The network I/F 28 is an interface that is provided to allow the image forming apparatus 1 to communicate with other devices via a network. An Ethernet (registered trademark) interface or a USE (universal serial bus) interface is used as the network I/F 28.

The controller 20 is composed of a combination of software and hardware. Specifically, the controller 20 includes a software control unit that is configured by an arithmetic operation performed by the CPU 10 in accordance with a program stored in the ROM 12 or a program loaded to the RAM 11 from a non-volatile memory, the HDD 14, or an optical disk and hardware such as an integrated circuit. The controller 20 functions as a control unit that controls the entire image forming apparatus 1.

The main control unit 30 plays a role of controlling the units included in the controller 20 and gives an instruction to each of the units of the controller 20. The engine control unit 31 serves as a drive unit that controls or drives the print engine 26, the scanner unit 22, and the like. The input/output control unit 32 inputs a signal or instruction input via the network I/F 28 to the main control unit 30. Further, the main control unit 30 controls the input/output control unit 32 and accesses another device via the network I/F 28.

The image processing unit 33 generates drawing information on the basis of printing information included in a printing job input thereto in accordance with the control of the main control unit 30. The drawing information is information for drawing an image that should be formed by the print engine 26 as an image forming unit in an image forming operation. Further, the printing information included in the printing job is image information that is converted in a form that can be recognized by the image forming apparatus 1 by a printer driver installed in an information processing device such as a PC. The operation display control unit 34 displays information on the display panel 24 or notifies the main control unit 30 of information input through the display panel 24.

When the image forming apparatus 1 operates as a printer, the input/output control unit 32 first receives a printing job via the network I/F 28. The input/output control unit 32 transfers the received printing job to the main control unit 30. Upon receiving the printing job, the main control unit 30 controls the image processing unit 33 to allow the image processing unit 33 to generate drawing information on the basis of printing information included in the printing job.

When the drawing information is generated by the image processing unit 33, the engine control unit 31 controls the print engine 26 on the basis of the generated drawing information to perform image formation on a sheet conveyed from the sheet feeding table 25. That is, the print engine 26 functions as an image forming unit. A document on which an image has been formed by the print engine 26 is discharged to the sheet discharge tray 27.

When the image forming apparatus 1 operates as a scanner, the operation display control unit 34 or the input/output control unit 32 transfers a scan execution signal to the main control unit 30 in response to a scan execution instruction input by an operation on the display panel 24 by a user or input from an external PC or the like via the network I/F 28. The main control unit 30 controls the engine control unit 31 on the basis of the received scan execution signal.

The engine control unit 31 drives the ADF 21 to convey an imaging target document set on the ADF 21 to the scanner unit 22. Further, the engine control unit 31 drives the scanner unit 22 to image the document conveyed from the ADF 21. When a document is not set on the ADF 21, but directly set on the scanner unit 22, the scanner unit 22 images the set document in accordance with the control of the engine control unit 31. That is, the scanner unit 22 operates as an imaging unit.

In an imaging operation, an imaging element such as a CCD included in the scanner unit 22 optically scans a document and imaging information is thereby generated on the basis of optical information. The engine control unit 31 transfers the imaging information generated by the scanner unit 22 to the image processing unit 33. The image processing unit 33 generates image information on the basis of the imaging information received from the engine control unit 31 in accordance with the control of the main control unit 30. The image information generated by the image processing unit 33 is stored in a recording medium such as the HDD 14 attached to the image forming apparatus 1. That is, the scanner unit 22, the engine control unit 31, and the image processing unit 33 coordinate to function as a document reading unit.

The image information generated by the image processing unit 33 is stored as it is in the HDD 14 or the like or transmitted to an external device via the input/output control unit 32 and the network I/F 28 in response to an instruction from a user. That is, the ADF 21 and the engine control unit 31 function as an image input unit.

When the image forming apparatus 1 operates as a copier, the image processing unit 33 generates drawing information on the basis of imaging information received by the engine control unit 31 from the scanner unit 22 or image information generated by the image processing unit 33. The engine control unit 31 drives the print engine 26 on the basis of the drawing information in the same manner as in the printer operation.

Figure 3:
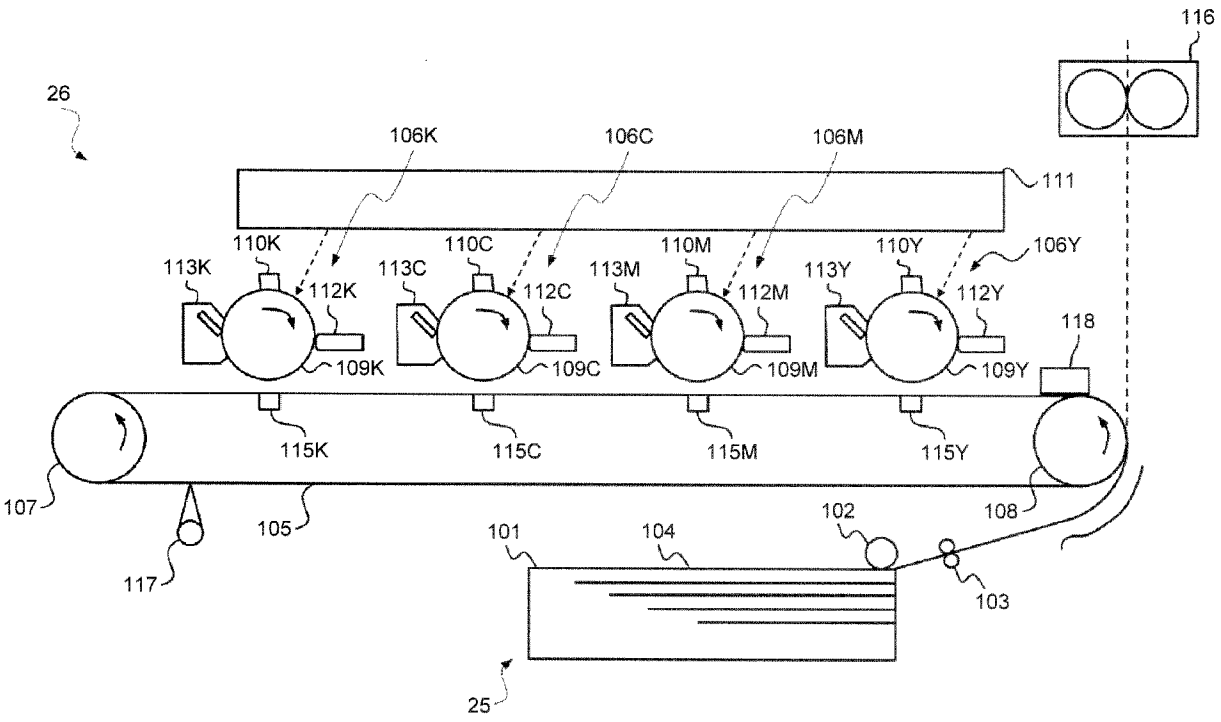
FIG. 3 is a diagram illustrating the configuration of a print engine according to the embodiment of the present invention.

Next, the configuration of the print engine 26 according to the present embodiment will be described with reference to FIG. 3. As illustrated in FIG. 3, the print engine 26 according to the present embodiment is a so-called tandem type, and has a configuration in which a plurality of image forming units 106 for different colors are arranged along a conveying belt 105 which is an endless moving unit. More specifically, along the conveying belt 105 which is an intermediate transfer belt (an image conveying member) on which an intermediate transfer image to be transferred onto a sheet (an example of a recording medium) 104 which is separately fed from a sheet feeding tray 101 by a sheet feeding roller 102 is formed, a plurality of image forming units (electrophotographic process unit) 106Y, 106M, 106C, and 106K (hereinbelow, collectively referred to as "image forming unit(s) 106") are arranged in this order from the upstream side in a conveying direction of the conveying belt 105.

The sheet 104 fed from the sheet feeding tray 101 is temporarily stopped by a registration roller 103 and fed to a transfer position where an image is transferred from the conveying belt 105 in accordance with timing of image formation performed by the image forming unit 106.

The image forming units 106Y, 106M, 1060, and 106K only differ from each other in color of toner images, that is, developer images to be formed, and have the same internal configuration. The image forming unit 106K forms a black image, the image forming unit 106M forms a magenta image, the image forming unit 106C forms a cyan image, and the image forming unit 106Y forms a yellow image. In the following description, the image forming unit 106Y will be specifically described. The other image forming units 106M, 106C, and 106K are similar to the image forming unit 106Y. Therefore, for each element of the image forming units 106M, 106C, and 106K, a reference numeral distinguished by "M", "C", or "K" will be used in the drawings instead of "Y" used for each element of the image forming unit 106Y, and description thereof will be omitted.

The conveying belt 105 is an endless belt provided across a drive roller 107 which is driven to rotate and a driven roller 108. The drive roller 107 is driven to rotate by a drive motor (not illustrated). The drive motor, the drive roller 107, and the driven roller 108 function as a drive unit that moves the conveying belt 105 as the endless moving unit.

In image formation, the first image forming unit 106Y transfers a yellow toner image onto the conveying belt 105 which is driven to rotate. The image forming unit 106Y includes a photoconductor drum 109Y as a photoconductor, and a charger 110Y, an optical writing device 111, a developing device 112Y, a photoconductor cleaner (not illustrated), and a discharger 113Y which are arranged around the photoconductor drum 109Y. The optical writing device 111 emits light to photoconductor drums 109Y, 109M, 109C, and 109K (hereinbelow, collectively referred to as "photoconductor drums 109").

In image formation, the outer peripheral surface of the photoconductor drum 109Y is uniformly charged by the charger 110Y in the dark. Then, writing is performed by light from a light source of the optical writing device 111 corresponding to a yellow image. As a result, an electrostatic latent image is formed on the outer peripheral surface of the photoconductor drum 109Y. The developing device 112Y develops the electrostatic latent image into a visible image using yellow toner. As a result, a yellow toner image is formed on the photoconductor drum 109Y.

The toner image is transferred onto the conveying belt 105 at a position (transfer position) where the conveying belt 105 comes into contact with or comes closest to the photoconductor drum 109Y by the action of a transfer device 115Y. As a result of the transfer, an image of the yellow toner is formed on the conveying belt 105. After the transfer of the toner image is finished, unnecessary toner remaining on the outer peripheral surface of the photoconductor drum 109Y is wiped away by the photoconductor cleaner. Then, the photoconductor drum 109Y is discharged by the discharger 113Y and put on standby for the next image formation.

The yellow toner image transferred onto the conveying belt 105 by the image forming unit 106Y in this manner is conveyed to the next image forming unit 106M by driving the conveying belt 105 by the roller. In the image forming unit 106M, a magenta toner image is formed on the photoconductor drum 109M by a process similar to the image forming process performed in the image forming unit 106Y. The formed toner image is transferred so as to be superimposed on the previously-formed yellow image.

The yellow and magenta toner image transferred onto the conveying belt 105 is further conveyed to the next image forming units 106C and 106K. Then, a cyan toner image formed on the photoconductor drum 109C and a black toner image formed on the photoconductor drum 109K are sequentially transferred so as to be superimposed on the previously-transferred image by a similar operation. In this manner, a full-color intermediate transfer image is formed on the conveying belt 105.

The sheets 104 stored in the sheet feeding tray 101 are sequentially fed from the top one and the intermediate transfer image formed on the conveying belt 105 is transferred onto the surface of the fed sheet 104 at a position where a conveyance path comes into contact with or comes closest to the conveying belt 105. Accordingly, an image is formed on the surface of the sheet 104. The sheet 104 having the image formed on the surface thereof is further conveyed, and the image is fixed thereon by a fixing device 116. Then, the sheet 104 is discharged to the outside of the image forming apparatus 1.

In such a print engine 26, toner images of the respective colors may not be superimposed at a position where the images should be originally superimposed, that is, position shift between the colors may occur because of an error in the center distance of the photoconductor drums 109Y, 109M, 109C, and 109K, an error in the parallelism of the photoconductor drums 109Y, 109M, 109C, and 109K, an error in the placement of an LEDA 130 inside the optical writing device 111, an error in timing of writing an electrostatic latent image to the photoconductor drums 109Y, 109M, 109C, and 109K, or the like.

Further, because of the same reasons as above, an image may be transferred onto an area deviated from an area within which the image should be originally transferred in a transfer target sheet. As a component of such position shift, skew and misregistration in the sub-scanning direction are mainly known. Further, expansion and contraction of the conveying belt caused by a change in the temperature inside the apparatus or deterioration with time is also known.

In order to correct such position shift, a pattern detection sensor 117 is provided. The pattern detection sensor 117 is an optical sensor for reading a position shift correction pattern and a density correction pattern both transferred onto the conveying belt 105 by the photoconductor drums 109Y, 109M, 109C, and 109K, and includes a light emitting element for emitting light to a pattern drawn on the surface of the conveying belt 105 and a light receiving element for receiving light reflected by the correction patterns. As illustrated in FIG. 3, the pattern detection sensor 117 is supported on the same substrate along a direction perpendicular to the conveying direction of the conveying belt 105 on the downstream side of the photoconductor drums 109Y, 109M, 109C, and 109K.

In the image forming apparatus 1, the density of an image transferred onto the sheet 104 may vary because of a change in the state of the image forming units 106Y, 106M, 1060 and 106K or a change in the state of the optical writing device 111. In order to correct such density variation, density correction is performed in such a manner that a density correction pattern that is formed in accordance with a predetermined rule is detected and a drive parameter for each of the image forming units 106Y, 106M, 1060 and 106K and a drive parameter for the optical writing device 111 are corrected on the basis of a result of the detection.

The pattern detection sensor 117 is also used for detecting a density correction pattern in addition to the above position shift correction operation performed by detecting a position shift correction pattern. Details of the pattern detection sensor 117 and a mode of the position shift correction will be specifically described below.

In order to remove toner of the correction pattern drawn on the conveying belt 105 in such drawing parameter correction to prevent a sheet conveyed by the conveying belt 105 from being soiled, a belt cleaner 118 is provided. As illustrated in FIG. 3, the belt cleaner 118 is a cleaning blade that is pressed against the conveying belt 105 on the downstream side of the drive roller 107 as well as on the upstream side with respect to the photoconductor drums 109 and serves as a developer removing unit that scrapes toner adhering onto the surface of the conveying belt 105.

Figure 4:
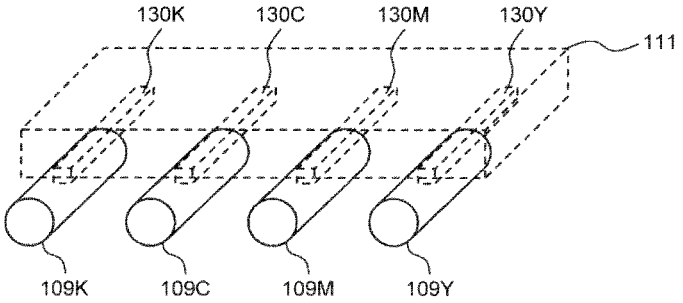
FIG. 4 is a diagram illustrating the configuration of an optical writing device according to the embodiment of the present invention.

Next, the optical writing device 111 according to the present embodiment will be described. FIG. 4 is a diagram illustrating the arrangement relationship between the optical writing device 111 and the photoconductor drums 109 according to the present embodiment. As illustrated in FIG. 4, light emitted to the photoconductor drums 109Y, 109M, 109C, and 109K of the respective colors is emitted from LEDAs (light-emitting diode arrays) 130Y, 130M, 130C, and 130K (hereinbelow, collectively referred to as "LEDA(s) 130") which are light sources.

The LEDA 130 includes a plurality of LEDs which are light emitting elements and arranged in a main-scanning direction of the photoconductor drum 109. A control unit included in the optical writing device 111 controls an on/off state of each of the LEDs arranged in the main-scanning direction with respect to each main scanning line on the basis of drawing information input from the controller 20, thereby selectively exposing the surface of the photoconductor drum 109 to light to form an electrostatic latent image thereon.

Figure 5:
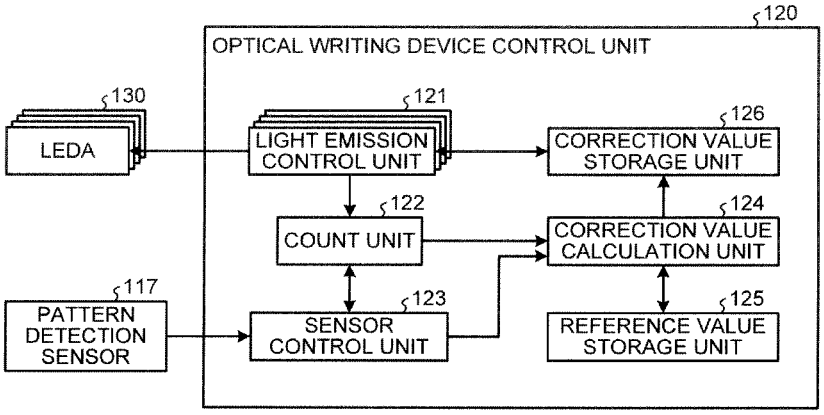
FIG. 5 is a block diagram illustrating the configuration of an optical writing control unit and an LEDA according to the embodiment of the present invention.

Next, a control block of the optical writing device 111 according to the present embodiment will be described with reference to FIG. 5. FIG. 5 is a diagram illustrating the functional configuration of an optical writing device control unit 120 which control the optical writing device 111 according to the present embodiment and the connection relationship between the optical writing device control unit 120 and the LEDA 130 and between the optical writing device control unit 120 and the pattern detection sensor 117.

As illustrated in FIG. 5, the optical writing device control unit 120 according to the present embodiment includes a light emission control unit 121, a count unit 122, a sensor control unit 123, a correction value calculation unit 124, a reference value storage unit 125, and a correction value storage unit 126. The optical writing device control unit 120 functions as an optical writing control device that controls the LEDAs 130 as light sources to form an electrostatic latent image on the photoconductors.

The optical writing device 111 according to the present embodiment includes information processing mechanisms such as the CPU 10, the RAM 11, the ROM 12, and the HDD 14 as described above with reference to FIG. 1. The optical writing device control unit 120 as illustrated in FIG. 5 is configured in such a manner that the CPU 10 performs arithmetic processing in accordance with a program stored in the ROM 12 or a program loaded to the RAM 11 like the controller 20 of the image forming apparatus 1.

The light emission control unit 121 is a light source control unit that controls the LEDA 130 on the basis of image information input from the engine control unit 31 of the controller 20. The light emission control unit 121 allows the LEDA 130 to emit light at a predetermined line period to thereby achieve optical writing to the photoconductor drum 109.

The line period at which the light emission control unit 121 controls the LEDA 130 to emit light is determined depending on the output resolution of the image forming apparatus 1. When performing variable magnification in the sub-scanning direction depending on the ratio with the conveying speed of a sheet as described above, the variable magnification in the sub-scanning direction is performed by adjusting the line period by the light emission control unit 121.

The light emission control unit 121 drives the LEDA 130 on the basis of drawing information input from the engine control unit 31 and also controls the LEDA 130 to emit light for drawing a correction pattern in the processing of the drawing parameter correction described above.

As described above with reference to FIG. 4, a plurality of LEDAs 130 are provided corresponding to the respective colors. Therefore, as illustrated in FIG. 5, a plurality of light emission control units 121 are also provided corresponding to the respective LEDAs 130. A correction value that is generated as a result of position shift correction processing in drawing parameter correction processing is stored as a position shift correction value in the correction value storage unit 126 illustrated in FIG. 5. The light emission control unit 121 corrects timing of driving the LEDA 130 on the basis of the position shift correction value stored in the correction value storage unit 126.

Specifically, the correction of the timing of driving the LEDA 130 performed by the light emission control unit 121 is achieved by delaying the timing of driving the LEDA 130 to emit light in the unit of line period, that is, by shifting the line on the basis of drawing information input from the engine control unit 31. On the other hand, drawing information is input one after another at a predetermined period from the engine control unit 31. Therefore, in order to delay the light emission timing by shifting the line, it is necessary to hold the input drawing information and delay timing of reading the held drawing information.

Therefore, the light emission control unit 121 includes a line memory which is a storage medium for holding drawing information input for each main scanning line and stores the drawing information input from the engine control unit 31 in the line memory to hold the drawing information. In the correction of the timing of driving the LEDA 130, fine adjustment on light emission timing for each line period is also performed in addition to the adjustment in the unit of line period.

The count unit 122 starts counting simultaneously when the light emission control unit 121 controls the LEDA 130 to thereby start exposure of the photoconductor drum 109K in the position shift correction processing described above. The count unit 122 acquires a detection signal that is output by the sensor control unit 123 when the sensor control unit 123 detects a position shift correction pattern on the basis of a signal output from the pattern detection sensor 117. Further, the count unit 122 inputs a count value at the timing of acquisition of the detection signal to the correction value calculation unit 124. That is, the count unit 122 functions as a detection timing acquisition unit that acquires pattern detection timing.

The sensor control unit 123 is a control unit that controls the pattern detection sensor 117. As described above, the sensor control unit 123 outputs a detection signal upon determining that a position shift correction pattern formed on the conveying belt 105 has reached the position of the pattern detection sensor 117 on the basis of a signal output from the pattern detection sensor 117. That is, the sensor control unit 123 functions as a detection signal acquisition unit that acquires a pattern detection signal output by the pattern detection sensor 117.

In density correction using a density correction pattern, the sensor control unit 123 acquires the intensity of a signal output from the pattern detection sensor 117 and inputs the acquired signal intensity to the correction value calculation unit 124. Further, the sensor control unit 123 adjusts timing of detecting a density correction pattern depending on a result of the detection of a position shift correction pattern.

The correction value calculation unit 124 calculates a correction value on the basis of a count value acquired from the count unit 122 and the signal intensity in the result of the detection of the density correction pattern acquired from the sensor control unit 123 and on the basis of reference values for position shift correction and density correction stored in the reference value storage unit 125. That is, the correction value calculation unit 124 functions as both a reference value acquisition unit and a correction value calculation unit. The reference value storage unit 125 stores therein reference values used for such calculation.

Figure 6:
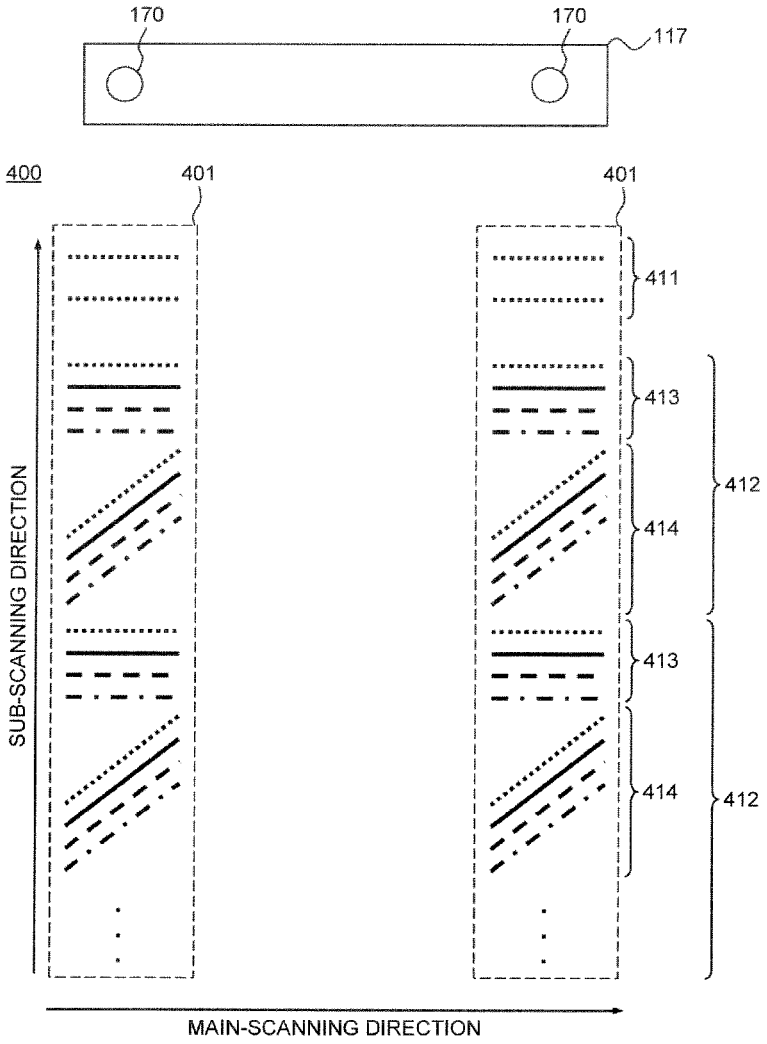
FIG. 6 is a diagram illustrating an example of a correction pattern according to the embodiment of the present invention.

Next, the position shift correction operation using a position shift correction pattern will be described. First, as a premise of the position shift correction operation according to the present embodiment, a general position shift correction operation will be described. FIG. 6 is a diagram illustrating a mark that is drawn on the conveying belt 105 by the LEDAs 130 controller by the respective light emission control units 121 (hereinbelow, referred to as "position shift correction mark") in a general position shift correction operation.

As illustrated in FIG. 6, a general position shift correction mark 400 includes a plurality of (two in the present embodiment) position shift correction pattern rows 401 arranged in the main-scanning direction. Each of the position shift correction pattern rows 401 includes various patterns arranged in the sub-scanning direction. In FIG. 6, a pattern drawn by the photoconductor drum 109K is indicated by a solid line, a pattern drawn by the photoconductor drum 109Y is indicated by a dotted line, a pattern drawn by the photoconductor drum 109C is indicated by a broken line, and a pattern drawn by the photoconductor drum 109M is indicated by a dashed line.

As illustrated in FIG. 6, the pattern detection sensor 117 includes a plurality of (two in the present embodiment) sensor elements 170 arranged in the main-scanning direction. Each of the position shift correction pattern rows 401 is drawn at a position corresponding to each of the sensor elements 170. Accordingly, the optical writing device control unit 120 can perform pattern detection at a plurality of positions in the main-scanning direction, and can correct the skew of an image to be drawn. Further, by averaging detection results based on the plurality of sensor elements 170, the correction accuracy can be improved.

As illustrated in FIG. 6, each of the position shift correction pattern rows 401 includes an entire position correction pattern 411 and a drum interval correction pattern 412. Further, as illustrate in FIG. 6, the drum interval correction pattern 412 is repeatedly drawn.

As illustrated in FIG. 6, the entire position correction pattern 411 is a line which is drawn by the photoconductor drum 109Y and parallel to the main-scanning direction. The entire position correction pattern 411 is a pattern drawn for acquiring a count value for correcting shift of the entire image in the sub-scanning direction, that is, a transfer position of an image with respect to a sheet. Further, the entire position correction pattern 411 is used also for correcting detection timing when the sensor control unit 123 detects the drum interval correction pattern 412 and a density correction pattern (described below).

In entire position correction using the entire position correction pattern 411, the optical writing device control unit 120 performs an operation for correcting writing start timing on the basis of a read signal of the entire position correction pattern 411 read by the pattern detection sensor 117.

The drum interval correction pattern 412 is a pattern drawn for acquiring a count value for correcting shift of drawing timing in the photoconductor drums 109 of the respective colors, that is, a superimposed position where images of the respective colors are superimposed. As illustrated in FIG. 6, the drum interval correction pattern 412 includes a sub-scanning direction correction pattern 413 which is a horizontal line pattern and a main-scanning direction correction pattern 414 which is an oblique line pattern. As illustrated in FIG. 6, the drum interval correction pattern 412 is configured by repeatedly drawing the sub-scanning direction correction pattern 413 which includes a set of patterns of the respective C, M, Y, and K colors and the main-scanning direction correction pattern 414 which includes a set of patterns of the respective C, M, Y, and K colors.

The optical writing device control unit 120 performs position shift correction in the sub-scanning direction for each of the photoconductor drums 109K, 109M, 109C, and 109Y on the basis of a read signal of the sub-scanning direction correction pattern 413 read by the pattern detection sensor 117 and performs position shift correction in the main-scanning direction for each of the photoconductor drums 109K, 109M, 109C, and 109Y on the basis of a read signal of the main-scanning direction correction pattern 414 read by the pattern detection sensor 117.

The sub-scanning direction correction pattern 413 is a horizontal pattern that is parallel to the main-scanning direction. Further, as illustrated in FIG. 6, by repeatedly drawing the drum interval correction pattern 412 in the sub-scanning direction, a plurality of sub-scanning direction correction patterns 413 are included in the position shift correction mark at different positions in the sub-scanning direction.

The main-scanning direction correction pattern 414 is an oblique line pattern that is inclined relative to the main-scanning direction. Further, as illustrated in FIG. 6, by repeatedly drawing the drum interval correction pattern 412 in the sub-scanning direction, a plurality of main-scanning direction correction patterns 414 are included in the position shift correction mark at different positions in the sub-scanning direction.

Figure 7:
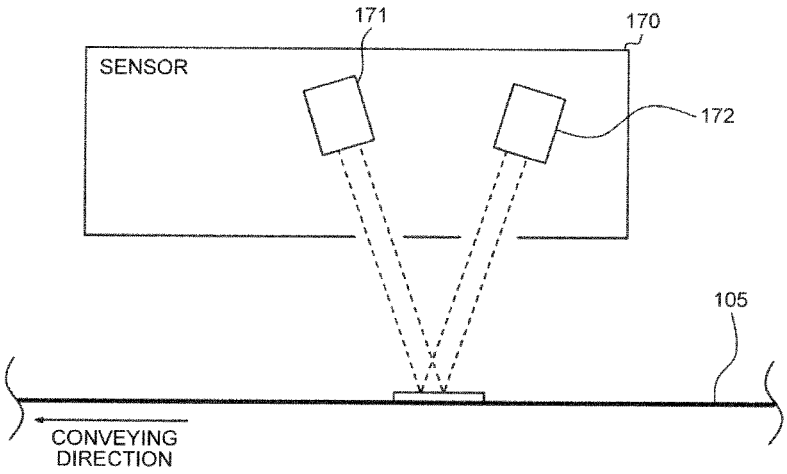
FIG. 7 is a diagram illustrating a pattern detection mode according to the embodiment of the present invention.

Here, a mode of pattern detection performed by the sensor element 170 according to the present embodiment will be described. FIG. 7 is a side cross-sectional view schematically illustrating the configuration of the sensor element 170 according to the present embodiment and a state when the sensor element 170 detects a pattern. FIG. 7 is a cross-sectional view in a plane that is perpendicular to the main-scanning direction and includes the sensor element 170.

As illustrated in FIG. 7, the sensor element 170 according to the present embodiment includes a light emitting element 171 and a light receiving element 172. The light emitting element 171 is a light source that emits a beam for detecting a pattern. The light emitting element 171 according to the present embodiment is composed of an LED light source that emits an optical beam.

The light receiving element 172 is a light receiving unit that receives light emitted from the light emitting element 171 and reflected by the conveying belt 105. As indicated by broken lines in FIG. 7, the light receiving element 172 is provided at a position with an angle where regular reflection light that is emitted from the light emitting element 171 and reflected by the conveying belt 105 enters. With such a configuration, the sensor element 170 according to the present embodiment outputs a signal corresponding to the intensity of light that is emitted from the light emitting element 171, reflected by the conveying belt 105, and then enters the light receiving element 172.

The conveying belt 105 according to the present embodiment has a white color which totally reflects light. When the surface of the conveying belt 105 is irradiated with light emitted from the light emitting element 171, the amount of light that enters the light receiving element 172 becomes the maximum. Then, when a pattern drawn on the conveying belt 105 is conveyed and passes across a beam spot of a beam emitted from the light emitting element 171, the beam is reflected not by the surface of the conveying belt 105, but by the pattern drawn thereon. As a result, the amount of reflected light that enters the light receiving element 172 decreases. By detecting the decrease in the amount of light received by the light receiving element 172, the sensor element 170 detects the pattern.

Figure 8:
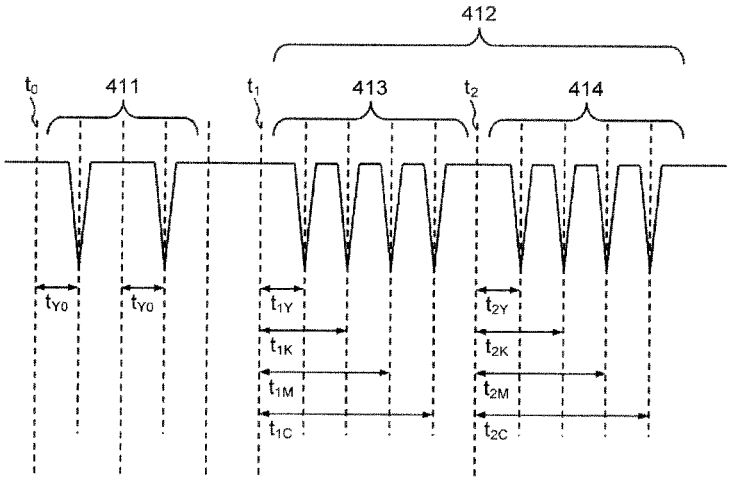
FIG. 8 is a diagram illustrating an example of timing of detecting a position shift correction pattern according to the embodiment of the present invention.

Next, timing reference values for the respective colors stored in the reference value storage unit 125 will be described with reference to FIG. 8. FIG. 8 is a diagram illustrating the intensity of a signal output from the pattern detection sensor 117 and timing of detecting the entire position correction pattern 411 and the drum interval correction pattern 412.

As described above with reference to FIG. 7, the sensor control unit 123 detects a pattern on the basis of a drop in the intensity of a detection signal output from the pattern detection sensor 117. As illustrated in FIG. 8, it is ideal to detect timing when a drop in the intensity of the detection signal becomes its peak as reaching timing of a pattern. Therefore, a predetermined threshold is set for the intensity of the detection signal in the sensor control unit 123, and a detection signal is output when the intensity of a signal output from the pattern detection sensor 117 reaches the threshold.

As a result, the correction value calculation unit 124 acquires count values at timing when the intensity of the signal drops and thereby passes across the threshold and timing when the intensity of the signal passes across the threshold when returning to its original intensity after the drop from the count unit 122. The correction value calculation unit 124 recognizes intermediate timing between the two timings as the reaching timing of each pattern.

As illustrated in FIG. 8, a detection period $t_{Y0}$ of the entire position correction pattern 411 is a period from detection start timing to which is timing before reading each line drawn by the photoconductor drum 109Y.

Detection periods $t_{1Y}$, $t_{1K}$, $t_{1M}$, and $t_{1C}$ of the sub-scanning direction correction pattern 413 included in the drum interval correction pattern 412 are periods from detection start timing $t_1$ which is timing before reading a set of patterns. Further, detection periods $t_{2Y}$, $t_{2K}$, $t_{2M}$, and $t_{2C}$ of the main-scanning direction correction pattern 414 included in the drum interval correction pattern 412 are periods from detection start timing $t_2$ which is timing before reading a set of patterns.

The reference value storage unit 125 stores therein reference values for the detection period $t_{Y0}$ of the entire position correction pattern 411 and the detection periods $t_{1Y}$, $t_{1K}$, $t_{1M}$, $t_{1C}$, $t_{2Y}$, $t_{2K}$, $t_{2M}$, and $t_{2C}$ of the sub-scanning direction correction pattern 413 and the main-scanning direction correction pattern 414 illustrated in FIG. 8. In other words, the reference value storage unit 125 stores therein, as reference values, theoretical values of the detection period $t_{Y0}$ of the entire position correction pattern 411 and the detection periods $t_Y$, $t_K$, $t_M$, and $t_C$ of the sub-scanning direction correction pattern 413 and the main-scanning direction correction pattern 414 when detailed configurations of the respective units of the image forming apparatus are as designed.

That is, the correction value calculation unit 124 calculates the difference between each of the reference values stored in the reference value storage unit 125 and each of the detection periods $t_{Y0}$, $t_Y$, $t_K$, $t_M$, and $t_C$ illustrated in FIG. 8 to thereby obtain deviation from the designed value of the image processing apparatus on which the correction value calculation unit 124 is mounted. Then, the correction value calculation unit 124 calculates a correction value for correcting light emission timing of the LEDAs 130 on the basis of the obtained deviation.

Further, the reference value for the detection period $t_{Y0}$ of the entire position correction pattern 411 is used also for correcting the detection start timings $t_1$ and $t_2$ illustrated in FIG. 8. That is, the correction value calculation unit 124 calculates a correction value for correcting the detection start timings $t_1$ and $t_2$ illustrated in FIG. 8 on the basis of the difference between the detection period $t_{Y0}$ of the entire position correction pattern 411 and the reference value corresponding thereto. Accordingly, it is possible to improve the accuracy of the detection period of the drum interval correction pattern 412.

The position shift correction mark 400 is drawn at every position shift correction operation which is repeatedly performed at predetermined timing. Therefore, it is required to reduce a drawing range as far as possible to reduce toner consumption. Therefore, it is ideal to set the width in the main-scanning direction of each of the patterns illustrated in FIG. 6 to a width corresponding to a detection range of the sensor element 170. In other words, it is ideal to form each of the patterns that constitute the position shift correction mark 400 into a narrow pattern that is drawn with a width corresponding to a reading range of the sensor element 170.

Figure 9:
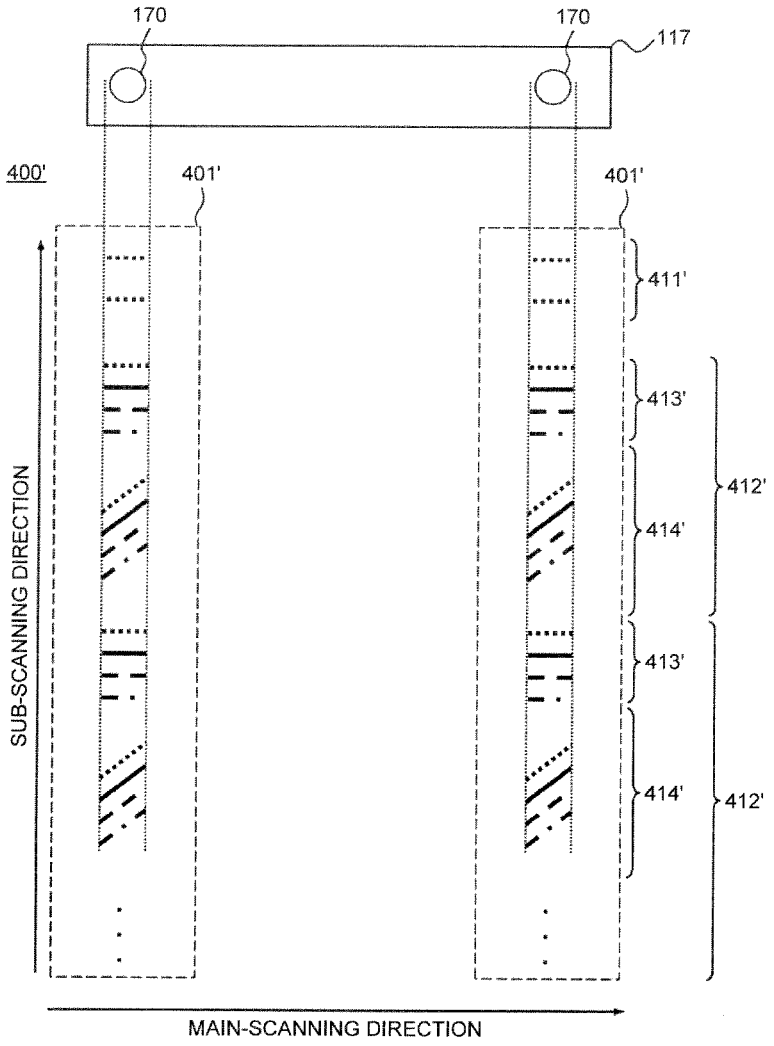
FIG. 9 is a diagram illustrating an example of a position shift correction pattern as a narrow pattern according to the embodiment of the present invention.

FIG. 9 is a diagram illustrating a position shift correction mark 400' according to the present embodiment. As illustrated in FIG. 9, each pattern included in the position shift correction mark 400' corresponds to each of the patterns included in the position shift correction mark 400 described above with reference to FIG. 6. In FIG. 9, "'" is attached to a reference numeral of a pattern corresponding to each of the patterns illustrated in FIG. 6.

As illustrated in FIG. 9, the position shift correction mark 400' according to the present embodiment is a narrow pattern in which the width in the main-scanning direction of all of the patterns corresponds to the detection range of the sensor element 170. Accordingly, as described above, the amount of toner consumed when drawing the position shift correction mark 400' is reduced. The position shift correction mark 400' illustrated in FIG. 9 is defined as a narrow pattern as just described and, on the other hand, the position shift correction mark 400 illustrated in FIG. 5 is defined as a wide pattern.

When detecting a pattern having a width that corresponds to the detection range of the sensor element 170 like the position shift correction mark 400', it is possible to reduce the influence of diffusely reflected light in the detection performed by the sensor element 170. Therefore, it is possible to perform position shift correction with high accuracy that reduces the influence of diffusely reflected light compared to the case in which a pattern having a margin in the main-scanning direction with respect to the detection range of the sensor element 170 as illustrated in FIG. 6 is used.

Figure 10:
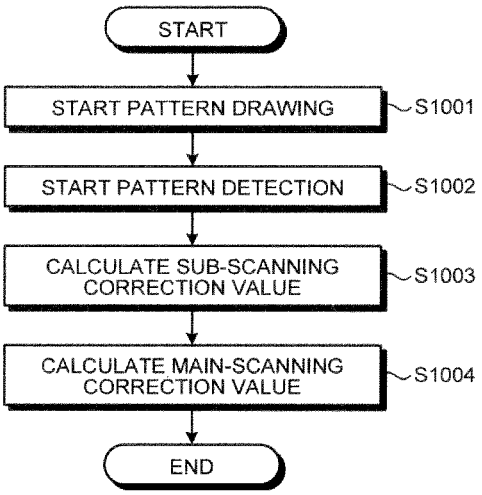
FIG. 10 is a flowchart illustrating a position shift correction operation according to the embodiment of the present invention.
Figure 11A:
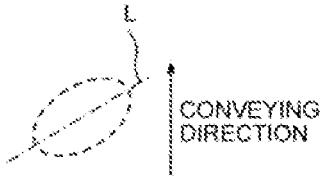
FIGS. 11*a*-11*d* are diagrams illustrating the relationship between a spot angle and a pattern angle according to the embodiment of the present invention.
Figure 11B:
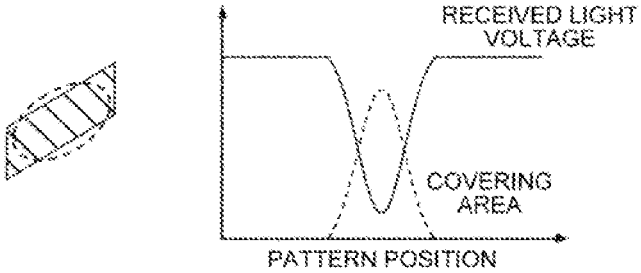
Figure 11C:
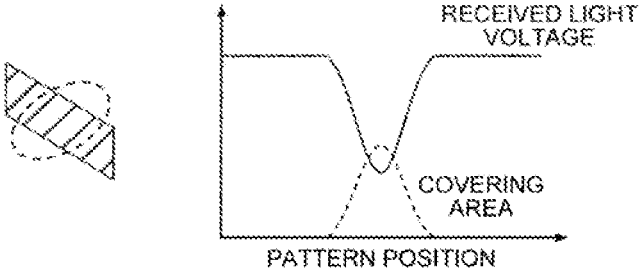
Figure 11D:
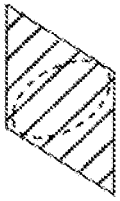

Next, the position shift correction operation according to the present embodiment will be described with reference to a flowchart of FIG. 10. As illustrated in FIG. 10, in the position shift correction operation, the optical writing device control unit 120 starts drawing of a pattern (S1001), and starts detection of the pattern on the basis of a detection signal from the pattern detection sensor 117 (S1002). Accordingly, the correction value calculation unit 124 sequentially acquires detection results of the entire position correction pattern 411 and the drum interval correction pattern 412, that is, values indicating detection timing.

Then, the correction value calculation unit 124 calculates a correction value for correcting position shift in the sub-scanning direction on the basis of the acquired detection results (S1003). In S1003, the correction value calculation unit 124 compares the detection results of the entire position correction pattern 411 and the sub-scanning direction correction pattern 413 with the reference value for the detection period $t_{Y0}$ described above with reference to FIG. 8 to thereby obtain a position shift correction amount in the sub-scanning direction.

Further, the correction value calculation unit 124 calculates a correction value for correcting position shift in the main-scanning direction on the basis of the acquired detection results (S1004). In S1004, the correction value calculation unit 124 compares the detection results of the sub-scanning direction correction pattern 413 and the main-scanning direction correction pattern 414 with the reference values for the detection periods $t_Y$, $t_K$, $t_M$, and $t_C$ described above with reference to FIG. 8 to thereby obtain a position shift correction amount in the main-scanning direction. By performing such processing, the position shift correction operation according to the present embodiment is completed. The pattern to be drawn may be both the wide pattern and the narrow pattern described above.

In such a configuration, the gist according to the present embodiment is to optimize the relationship between the angle of the main-scanning direction correction pattern 414 which is an oblique line pattern and the shape of a beam spot that is generated when a beam emitted from the light emitting element 171 of the sensor element 170 reaches the surface of the conveying belt 105. First, the shape of the beam spot will be described.

As described above with reference to FIG. 7, the optical axis of a beam emitted from the light emitting element 171 is inclined relative to a belt surface of the conveying belt 105 so that reflected light enters the light receiving element 172. Therefore, even when a beam emitted from the light emitting element 171 has a perfect circular shape, a beam spot generated when the beam reaches the belt surface of the conveying belt 105 is formed into an elliptical shape.

Further, there is an individual difference in the arrangement of the light emitting element 171 and the light receiving element 172 as illustrated in FIG. 7 between sensor elements 170. A direction in which the elliptical shape of the beam spot described above has the maximum diameter, that is, the angle in the longitudinal direction of the ellipse differs depending on the individual difference between sensor elements 170.

FIG. 11(*a*) is a diagram illustrating an example of the elliptical beam spot on the surface of the conveying belt 105 using a broken line. As indicated by an arrow in the drawing, an up-down direction in the drawing is the conveying direction of the conveying belt 105. As indicated by a dashed line in the drawing, a longitudinal direction L of the ellipse is inclined relative to the conveying direction. The inclination of L differs depending on the individual difference between sensor elements 170.

The inclination of L affects a detection signal when detecting an oblique line pattern. Specifically, when the inclination of L and the inclination of an oblique line pattern are close to each other, a range that covers the beam spot becomes large when the oblique line pattern is conveyed by the conveying belt 105 and reaches the position of the beam spot. On the other hand, the inclination of L and the inclination of an oblique line pattern largely differ from each other, a range that covers the beam spot becomes small when the oblique line pattern is conveyed by the conveying belt 105 and reaches the position of the beam spot.

FIG. 11(*b*) is a diagram illustrating the case in which the inclination of L and the inclination of an oblique line pattern are close to each other. As illustrated in FIG. 11(*b*), when the inclination of L and the inclination of an oblique line pattern are close to each other, the most part of the elliptical beam spot is covered with the oblique line pattern when the oblique line pattern reaches the beam spot.

In a graph illustrated on the right side of FIG. 11(*b*), the horizontal axis represents a conveying position of the pattern and the vertical axis represents an output signal output from the sensor element 170 indicated by a solid line and the area of the beam spot covered with the pattern indicated by a broken line. As illustrated in the graph, the peak of the area of the beam spot covered with the pattern is high, and, on the other hand, the peak of the output signal output from the sensor element 170 is low.

With such waveforms, it is possible to increase the difference between a received light voltage when a beam emitted from the light emitting element 171 is reflected by the surface of the conveying belt 105 and a threshold for detecting a drop in the signal, and thereby improve an S/N ratio.

FIG. 11(*c*) is a diagram illustrating the case in which the inclination of L and the inclination of an oblique line pattern largely differ from each other. As illustrated in FIG. 11(*c*), when the inclination of L and the inclination of an oblique line pattern largely differ from each other, a range in the oblique beam spot, the range not being covered with the pattern, becomes wide when the oblique line pattern reaches the beam spot. As a result, as illustrated in a graph on the right side, the peak of the area of the beam spot covered with the pattern is low and, on the other hand, the peak of the output signal output from the sensor element 170 is high.

With such waveforms, it is not possible to increase the difference between a received light voltage when a beam emitted from the light emitting element 171 is reflected by the surface of the conveying belt 105 and a threshold for detecting a drop in the signal. As a result, the S/N ratio is deteriorated, and, in some cases, it is not possible to detect a signal.

As illustrated in FIG. 11(*d*), the entire beam spot can be covered with a pattern by increasing the width in the sub-scanning direction of the pattern. However, in this case, a period during which the pattern passes across the beam spot in conveyance by the conveying belt 105 becomes long. As a result, the accuracy of detecting timing is lowered and toner consumption increases. Therefore, the state in which the angle of the oblique line pattern and the angle in the longitudinal direction of the beam spot are close to each other as illustrated in FIG. 11(*b*) is ideal in all aspects.

Therefore, the optical writing device control unit 120 according to the present embodiment performs an angle determination operation for determining the angle of an oblique line pattern to thereby determine the angle of the oblique line pattern corresponding to the individual difference between sensor elements 170 mounted on different image forming apparatuses 1. Hereinbelow, the angle determination operation according to the present embodiment will be described.

Figure 12:
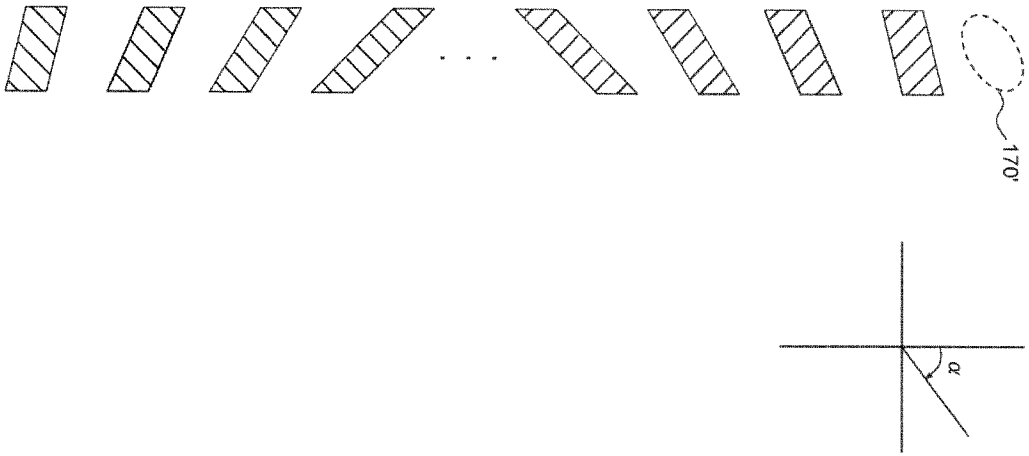
FIG. 12 is a diagram illustrating an example of an angle adjustment pattern according to the embodiment of the present invention.

FIG. 12 is a diagram illustrating an example of a mark that is drawn in the angle determination operation according to the present embodiment (hereinbelow, referred to as "angle determination mark"). The angle determination mark is used as an angle adjustment pattern for adjusting the angle of the oblique line pattern. As illustrated in FIG. 12, the angle determination mark according to the present embodiment includes oblique line patterns having different angles which are arranged in the sub-scanning direction. The gist according to the present embodiment is to determine the angle of the oblique line pattern on the basis of a drop in a detection signal when the patterns having different angles reach a beam spot 170'.

As described above with reference to FIGS. 11(*b*) and 11(*c*), the amount of a change in the detection signal output from the pattern detection sensor 117 varies depending on the relationship between the angle of the pattern and the angle in the longitudinal direction of the beam spot. Therefore, it is possible to determine a pattern angle that most closely matches the angle in the longitudinal direction of the beam spot 170' by drawing the angle determination mark as illustrated in FIG. 12 on the conveying belt 105 and referring to a detection signal thereof.

As illustrated on the right side of FIG. 12, when the conveying direction of the patterns is defined as a reference axis and a direction that extends right toward the downstream side of the conveying direction is defined as a plus angle, each of the oblique line patterns included in the angle determination mark according to the present embodiment has an inclination within the range of −0° to +90°. Although depending on definition of a plus direction, a minus direction and a reference axis, a value of the angle may be set within the range of 180° because it returns to its initial inclination when the pattern rotates by 180° or more.

Figure 13:
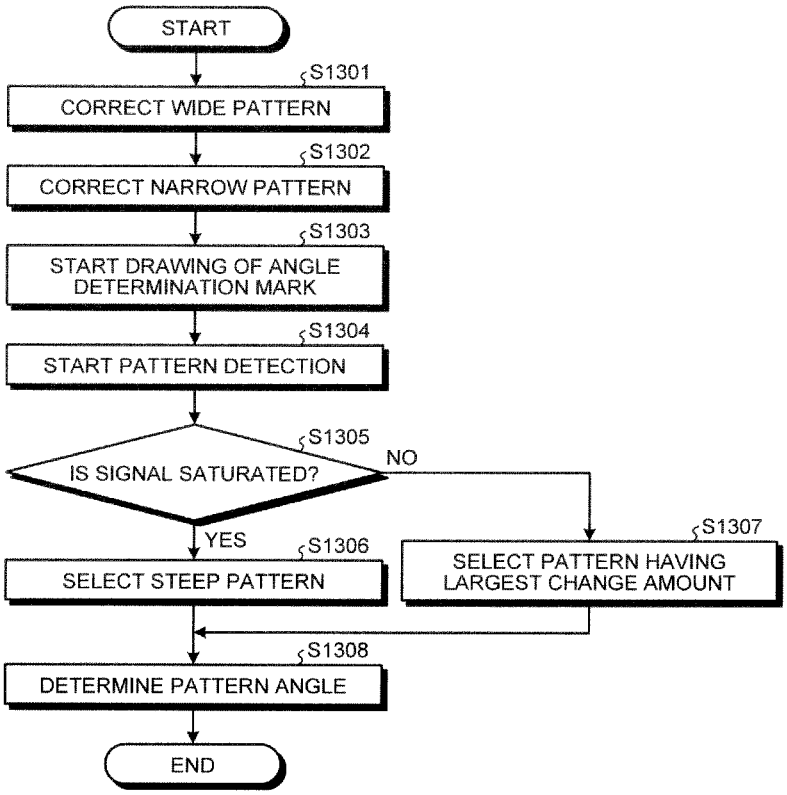
FIG. 13 is a flowchart illustrating an angle adjustment operation according to the embodiment of the present invention.

Next, the angle determination operation according to the present embodiment will be described with reference to a flowchart of FIG. 13. As illustrated in FIG. 13, the optical writing device control unit 120 first performs the position shift correction operation using the pattern described above with reference to FIG. 6, that is, the wide pattern having a margin with respect to the detection range of the sensor element 170 (S1301).

By performing the processing in S1301, even when the drawing position in the main-scanning direction is shifted, it is possible to perform the position shift correction in the main-scanning direction without a pattern detection error by virtue of the margin with respect to the detection range of the sensor element 170. Details of the processing in S1301 are the same as S1001 to S1004 of FIG. 10.

Then, the optical writing device control unit 120 performs the position shift correction operation using the pattern described above with reference to FIG. 9, that is, the narrow pattern whose width in the main-scanning direction corresponds to the detection range of the sensor element 170 (S1302). When using the narrow pattern, it is possible to reduce the influence of diffusely reflected light as described above and therefore perform the position shift correction with higher accuracy.

The processing in S1302 is performed by applying a position shift correction value obtained by the processing in S1301. Therefore, the position in the main-scanning direction of an image to be drawn is previously corrected. Thus, even when using a narrow pattern as illustrated in FIG. 9, a pattern detection error does not occur. Further, the position shift correction with high accuracy is completed by the processing in S1301 and S1302. Therefore, in image forming output that is subsequently performed, the position shift is corrected with high accuracy.

When the processing in S1302 is completed, the optical writing device control unit 120 starts drawing of the angle determination mark described above with reference to FIG. 12 (S1303), and starts detection of a pattern on the basis of a detection signal from the pattern detection sensor 117 (S1304). Accordingly, the correction value calculation unit 124 sequentially acquires the amount of a drop in the detection signal from the pattern detection sensor 117 when the oblique line patterns having different angles as illustrated in FIG. 12 reach the beam spot 170'.

FIGS. 14(*a*) to 14(*h*) are diagrams each illustrating an example of the detection signal from the pattern detection sensor 117 for each of the patterns illustrated in FIG. 12. As illustrated in FIGS. 14(*a*) to 14(*h*), a mode of a drop in the detection signal that is output from the pattern detection sensor 117 when each of the patterns passes through the beam spot differs depending on the angle of the pattern. The mode of a drop in the detection signal indicates a signal intensity corresponding to the drop and the width of the drop of the signal.

As described above with reference to FIGS. 11(*b*) and 11(*c*), in a drop in the detection signal, the S/N ratio is improved as the signal intensity decreases. Therefore, upon acquiring the signal intensity of each detection signal from the sensor control unit 123, the correction value calculation unit 124 compares the signal intensities corresponding to the drop in the detection signals (S1305). The detection of the signal intensity of each detection signal is performed by setting multiple stages of thresholds as indicated by broken lines in FIGS. 14(*a*) to 14(*h*), and determining which threshold the signal intensity has exceeded.

By performing the processing in S1305, the correction value calculation unit 124 extracts a pattern angle at which a signal intensity corresponding to the drop in the detection signal is the lowest, that is, a pattern angle at which a change in the signal when detecting the pattern is the largest. In other words, the drop amount of a signal is the detection intensity of a pattern.

As a result, for example, when there are a plurality of pattern angles corresponding to the lowest threshold reached by the drop in the signal intensity as illustrated in FIGS. 14(*a*) to 14(*c*), that is, the drop in the signal is saturated (YES in S1305), the correction value calculation unit 124 selects a pattern angle having the steepest signal drop (S1306). The pattern angle having the steepest signal drop indicates a pattern angle that has the shortest possible period from when the pattern reaches the beam spot until when the pattern passes through the beam spot. In other words, the pattern angle having the steepest signal drop indicates a pattern angle that has the shortest period during which signal output from the pattern detection sensor 117 is varying by the conveyed pattern.

That is, when a period during which an output signal from the pattern detection sensor 117 is varying by covering the beam spot with a pattern is regarded as a period during which the pattern is detected in the conveyance path of the intermediate conveyance belt (image conveying member) 105, the angle of an oblique line pattern having the shortest possible detection period is selected.

The significance of the processing according to S1306 exists in the accuracy when detecting timing on the basis of a drop in the signal. As descried above with reference to FIG. 8, the pattern detection timing is intermediate timing between when the signal intensity crosses the threshold in the drop of the pattern detection signal and when the signal intensity crosses the threshold in the rise of the pattern detection signal. Therefore, when the drop width of the detection signal is narrower, an error in determination of the detection timing is reduced. Therefore, when there are a plurality of pattern angles having the lowest signal intensity corresponding to the drop, the correction value calculation unit 124 selects a pattern angle having the narrowest drop width.

On the other hand, when there is a single pattern angle having the lowest signal intensity corresponding to the drop (NO in S1305), the correction value calculation unit 124 selects the single pattern angle (S1307). When selecting the pattern angle by the processing in S1306 or S1307, the correction value calculation unit 124 determines the selected angle as the pattern angle of the oblique line pattern (S1308). That is, the correction value calculation unit 124 functions as an angle adjustment processing unit. By performing such an operation, the angle determination operation according to the present embodiment is completed.

By performing such an angle determination operation, an angle that is most suitable for the angle in the longitudinal direction of a beam spot generated by the light emitting element 171 of the pattern detection sensor 117 is selected from the angles of the oblique line patterns illustrated in FIG. 12. The pattern angle determined by the operation of FIG. 13 is stored in the correction value storage unit 126. Accordingly, when drawing the position shift correction mark 400 illustrated in FIG. 6 or the position shift correction mark 400' illustrated in FIG. 9 in the subsequent position shift correction operation, the determined angle is used as the angle of the oblique line pattern included in the mark.

Figure 15:
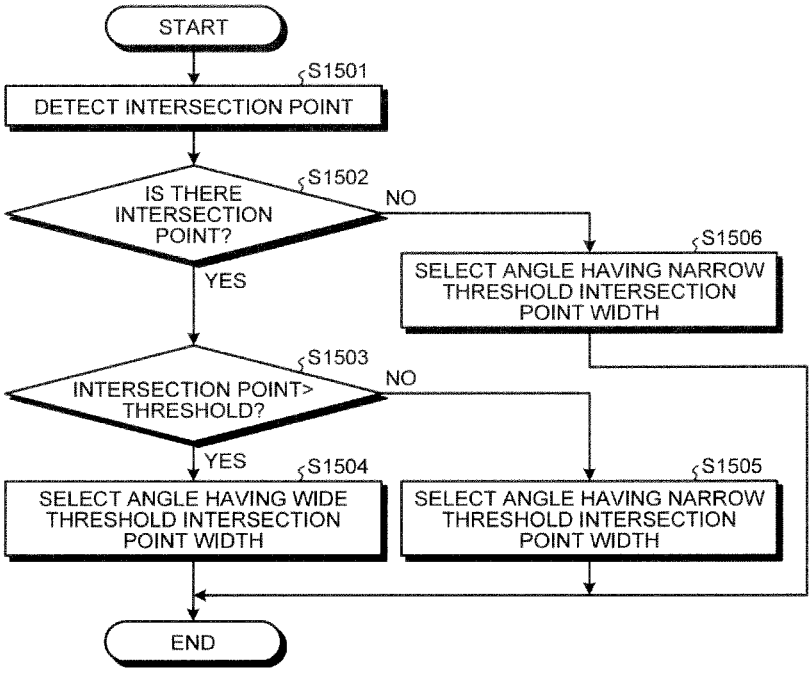
FIG. 15 is a flowchart illustrating an operation of selecting a steep pattern according to the embodiment of the present invention.

Next, details of steep pattern selection processing in S1306 of FIG. 13 will be described. FIG. 15 is a flowchart illustrating a detailed operation of the processing in S1306. The correction value calculation unit 124 refers to detection signals of the respective pattern angles corresponding to the lowest threshold reached by the drop of the signal intensity and detects an intersection point between graphs with peak timings of the drop in the detection signals matched (S1501). The intersection point between graphs indicates a point at which the graphs intersect each other.

Figure 16:
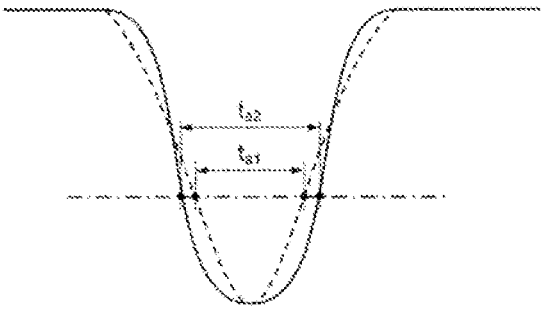
FIGS. 16*a*-16*c* are diagrams each illustrating a selection example of a steep pattern according to the embodiment of the present invention.
Figure 16:
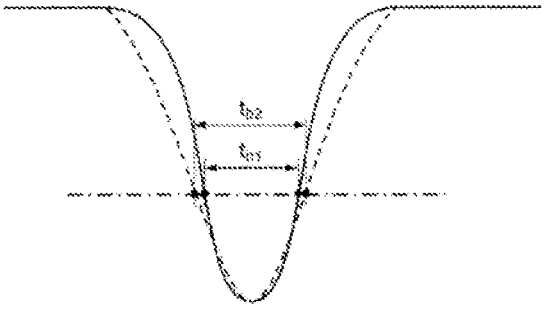
Figure 16:
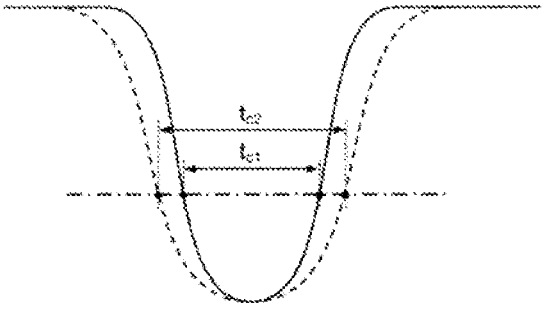
Figure 17:
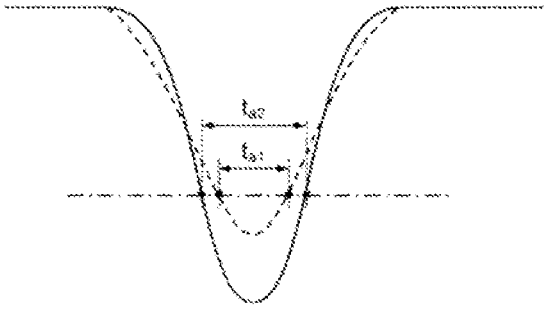
FIGS. 17*a*-17*b* are diagrams each illustrating another example relating to the selection of a pattern having the largest detection intensity according to the embodiment of the present invention.
Figure 17:
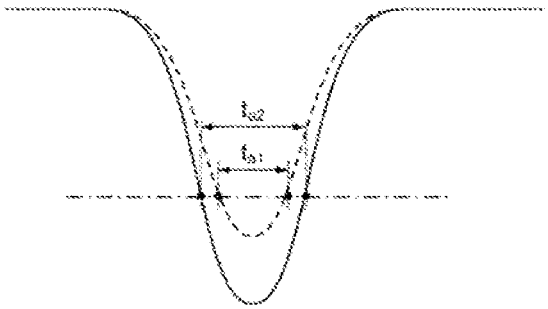

FIGS. 16(*a*) to 16(*c*) are diagrams each illustrating a state in which peak timings of two signals having saturated signal intensity are matched. FIGS. 16(*a*) and 16(*b*) illustrate a case in which there is an intersection point between graphs of the two signals. On the other hand, FIG. 16(*c*) illustrates a case in which there is no intersection point. When there is no intersection point as illustrated in FIG. 16(*c*) as a result of determination in S1502 (NO in S1502), a graph of a detection signal corresponding to a pattern angle that should be selected, that is, a graph having a steep drop is a graph indicated by a solid line in FIG. 16(*c*).

A dotted line illustrated in each of FIGS. 16(*a*) to 16(*c*) indicates a threshold for determining detection timing on the basis of a drop in the signal described above with reference to FIG. 8 (hereinbelow, referred to as "timing determination threshold"). In the state illustrated in FIG. 16(*c*), when comparing an interval $t_{C1}$ between two intersection points between the graph indicated by a solid line and the timing determination threshold with an interval $t_{C2}$ between two intersection points between the graph indicated by a broken line and the timing determination threshold (hereinbelow, referred to as "threshold intersection point width"), the solid-line graph that should be selected has a narrower threshold intersection point width. Therefore, the correction value calculation unit 124 selects a pattern angle corresponding to the graph having a narrow threshold intersection point width (S1506) and finishes the processing.

On the other hand, when the intersection point is detected (YES in S1502), the correction value calculation unit 124 thereafter determines whether or not the signal intensity at the intersection point between the graphs is larger than the timing determination threshold (S1503). As a result, when the signal intensity at the intersection point is larger than the timing determination threshold (YES in S1503), the graphs are in the state as illustrated in FIG. 16(*a*).

A graph that should be selected in the state illustrated in FIG. 16(*a*) is the graph indicated by a solid line. In this case, the solid-line graph that should be selected has a wider threshold intersection point width. Therefore, the correction value calculation unit 124 selects a pattern angle corresponding to the graph having a wide threshold intersection point width (S1504), and finishes the processing.

When the signal intensity at the intersection point is smaller than the timing determination threshold (NO in S1503), the graphs are in the state as illustrated in FIG. 16(*b*). A graph that should be selected in the state illustrated in FIG. 16(*b*) is the graph indicated by the solid line. In this case, the solid-line graph that should be selected has a narrower threshold intersection point width. Therefore, the correction value calculation unit 124 selects a pattern angle corresponding to the graph having a narrow intersection point width (S1505), and finishes the processing. By performing such processing, the steep pattern selection processing in S1306 of FIG. 13 is completed.

The method in which determination is made on the basis of the threshold intersection point width as illustrated in FIGS. 15 and 16(*a*) to 16(*c*) may be used not only in the selection of a steep pattern as described above, but also, for example, as a substitution of the processing in S1305 and S1307, that is, in the selection of a pattern having the largest drop in detection voltage. Also in this case, by performing determination on the basis of presence/absence of the intersection point between graphs and the relationship between the intersection point and the threshold in the same manner as illustrated in FIG. 15, it is possible to select a pattern having the largest drop in the detection signal.

Figure 18:
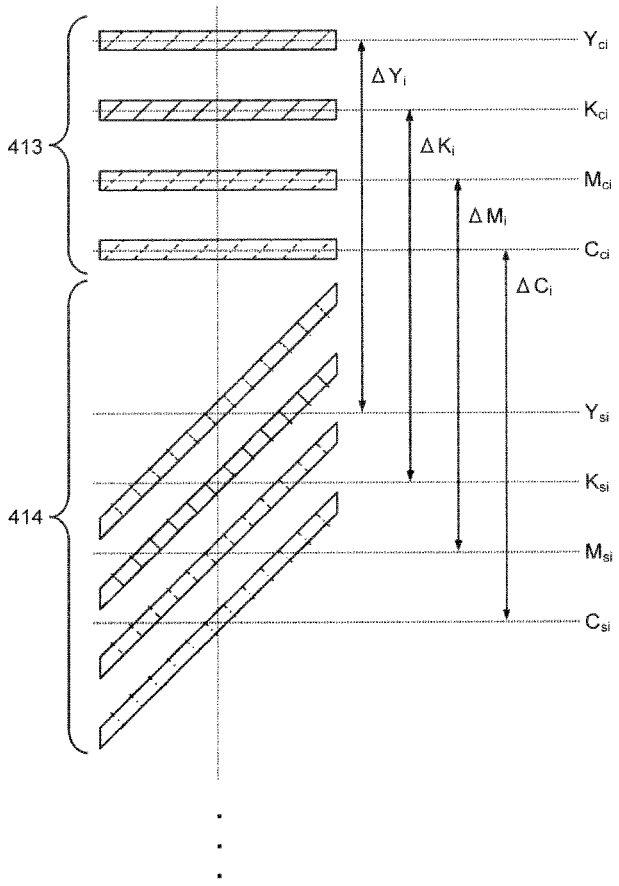
FIG. 18 is a diagram illustrating a reference mode of a pattern detection result according to the embodiment of the present invention.
Figure 19:
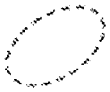
FIGS. 19*a*-19*c* are diagrams illustrating the relationship between a spot angle and a pattern angle.
Figure 19:
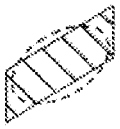
Figure 19:
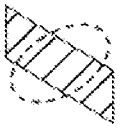

Next, processing for calculating a position shift amount in the main-scanning direction on the basis of a result of oblique line pattern detection in the position shift correction processing according to the present embodiment will be described. FIG. 18 is a diagram illustrating a reference mode of the pattern detection result in the position shift correction in the main-scanning direction according to the present embodiment. As illustrated in FIG. 18, detection timings of horizontal line patterns 413 are denoted by $Y_{ci}$, $K_{ci}$, $M_{ci}$, and $C_{ci}$. Further, detection timings of oblique line patterns 414 are denoted by $Y_{si}$, $K_{si}$, $M_{si}$, and $C_{si}$. Here, "i" indicates an order in the number of times of repetition of the horizontal line pattern 413 and the oblique line pattern 414 which are repeatedly drawn.

The optical writing device control unit 120 according to the present embodiment refers to periods $\Delta Y_i$, $\Delta K_i$, $\Delta M_i$, and $\Delta C_i$ each of which is a period from detection timing of the i-th horizontal line pattern 413 up to detection timing of the i-th oblique line pattern 414 for the respective colors as a detection result for first main-scanning position shift correction.

Even when an image is shifted in the main-scanning direction, the detection timing of the horizontal line pattern 413 does not change. On the other hand, as described above, the detection timing of the oblique line pattern 414 changes depending on the inclination of the oblique line along the main-scanning direction of an image. Therefore, the interval between the horizontal line pattern 413 and the oblique line pattern 414 changes because of position shift in the main-scanning direction of an image. The optical writing device control unit 120 according to the present embodiment performs the position shift correction in the main-scanning direction on the basis of a change in the interval between the horizontal line pattern 413 and the oblique line pattern 414.

That is, the reference value storage unit 125 stores therein reference values for the respective detection timings $Y_{ci}$, $K_{ci}$, $M_{ci}$, and $C_{ci}$ illustrated in FIG. 18 as reference values for position shift correction in the sub-scanning direction. The optical writing device control unit 120 performs the position shift correction in the sub-scanning direction of an image on the basis of the difference between a reading result of the horizontal line patterns 413 and the reference values stored in the reference value storage unit 125.

Further, the reference value storage unit 125 stores therein reference values for the respective periods $\Delta Y_i$, $\Delta K_i$, $\Delta M_i$, and $\Delta C_i$ illustrated in FIG. 8 as reference values for position shift correction in the main-scanning direction. The optical writing device control unit 120 performs the position shift correction in the main-scanning direction of the image on the basis of the difference between a reading result of the horizontal line patterns 413 and the oblique line patterns 414 and the reference values stored in the reference value storage unit 125.

A designed value of the interval between the horizontal line pattern and the oblique line pattern is equal between the Y, M, C, and K colors. Therefore, when there is no position shift in the main-scanning direction, the above periods $\Delta Y_i$, $\Delta K_i$, $\Delta M_i$, and $\Delta C_i$ can be respectively represented by the following Equations (1) to (5).

$$\Delta Y_i \Delta K_i = \Delta M_i = \Delta C_i = D \tag{1}$$

$$\Delta Y_i = Y_{si} - Y_{ci} \tag{2}$$

$$\Delta K_i = K_{si} - K_{ci} \tag{3}$$

$$\Delta M_i = M_{si} - M_{ci} \tag{4}$$

$$\Delta C_i = C_{si} - C_{ci} \tag{5}$$

On the other hand, when position shift in the main-scanning direction occurs in the Y, M, C, or K color, the detection position of the oblique line pattern changes, and the interval between the horizontal line pattern and the oblique line pattern of the corresponding color thereby changes. A default value of the angle $\alpha$ of the oblique line pattern according to the present embodiment is 45°. Therefore, for example, when the Y color is shifted in the main-scanning direction by $\Delta S_{Yi}$ and the K color is shifted in the main-scanning direction by $\Delta S_{Ki}$, a main-scanning position shift amount $\Delta S_{YKi}$ of Y with respect to K can be calculated by the following Equations (6) to (8).

$$\Delta Y_i = Y_{si} - Y_{ci} = D + \Delta S_{Yi} \tag{6}$$

$$\Delta K_i = K_{si} - K_{ci} = D + \Delta S_{Ki} \tag{7}$$

$$\Delta S_{YKi} = \Delta S_{Yi} - \Delta S_{Ki} = \Delta Y_i - \Delta K_i \tag{8}$$

In this manner, the position shift amount $\Delta S_{YKi}$ in the main-scanning direction of the position shift correction pattern can be calculated by the difference in pattern interval between K and Y. By performing the calculations of the above Equations (6) to (8) in all of the other colors in the same manner as above, it is possible to calculate a main-scanning position shift amount of Y, M, and C with respect to K and thereby correct the position shift.

Then, an average value in a plurality of patterns that are continuously formed is calculated by the following Equations (9) to (11), thereby obtaining the position shift amount in each of the colors.

$$\Delta S_{YK} = \frac{\sum_{i=1}^{k} (\Delta S_{YKi})}{k} \tag{9}$$

$$\Delta S_{MK} = \frac{\sum_{i=1}^{k} (\Delta S_{MKi})}{k} \tag{10}$$

$$\Delta S_{CK} = \frac{\sum_{i=1}^{k} (\Delta S_{CKi})}{k} \tag{11}$$

The above equations are used when the angle $\alpha$ of the oblique line pattern is 45°, that is, when the position shift amount in the main-scanning direction of the oblique line pattern is directly reflected in the position shift amount in the sub-scanning direction. On the other hand, when the angle $\alpha$ of the oblique line pattern varies because of the above angle adjustment operation, the main-scanning position shift amount $\Delta S_{YKi}$ of Y with respect to K can be calculated by the following Equations (12) to (14).

$$\Delta Y_i = Y_{si} - Y_{ci} = D + \Delta S_{Yi} \times \tan \alpha \tag{12}$$

$$\Delta K_i = K_{si} - K_{ci} = D + \Delta S_{Ki} \times \tan \alpha \quad (13)$$

$$\Delta S_{YKi} = \Delta S_{Yi} - \Delta S_{Ki} = (\Delta Y_i - \Delta K_i)/\tan \alpha \quad (14)$$

Further, $\Delta S_{MKi}$ and $\Delta S_{CKi}$ can also be calculated by the same calculation as the above Equation (14). By applying such $\Delta S_{YKi}$, $\Delta S_{MKi}$, and $\Delta S_{CKi}$ to the above Equations (9) to (11), even when the angle of the oblique line patterns is adjusted by the angle adjustment operation, the position shift amount in the main-scanning direction can be obtained on the basis of the detection result of the oblique line patterns.

As described above with reference to FIG. 12, the angle of the oblique line patterns corresponds to the angle of a beam spot of a beam emitted from the light emitting element 171 included in the sensor element 170. Therefore, all of the Y, M, C, and K colors have the same oblique line pattern angle. However, the Y, M, C, and K colors may have different oblique line pattern angles, for example, because of a difference in diffuse reflection characteristics of color. In this case, when the angles of oblique line patterns of the respective Y, M, C, and K colors are respectively denoted by $\alpha_Y$, $\alpha_M$, $\alpha_C$, and $\alpha_K$, the main-scanning position shift amount $\Delta S_{YKi}$ of Y with respect to K can be calculated by the following Equations (15) to (17).

$$\Delta Y_i = Y_{si} - Y_{ci} = D + \Delta S_{Yi} \times \tan \alpha_Y \quad (15)$$

$$\Delta K_i = K_{si} - K_{ci} = D + \Delta S_{Ki} \times \tan \alpha_K \quad (16)$$

$$\Delta S_{YKi} = \Delta S_{Yi} - \Delta S_{Ki} = (\Delta Y_i - D)/\tan \alpha_Y - (\Delta K_i - D)/\tan \alpha_K \quad (17)$$

In the same manner as Equation (14), the main-scanning position shift amount $\Delta S_{MKi}$ of M with respect to K and the main-scanning position shift amount $\Delta S_{CKi}$ of C with respect to K can be respectively calculated by the following Equations (18) and (19).

$$\Delta S_{MKi} = \Delta S_{Mi} - \Delta S_{Ki} = (\Delta M_i - D)/\tan \alpha_N - (\Delta K_i - D)/\tan \alpha_K \quad (18)$$

$$\Delta S_{CKi} = \Delta S_{Ci} - \Delta S_{Ki} = (\Delta C_i - D)/\tan \alpha_C - (\Delta K_i - D)/\tan \alpha_K \quad (19)$$

By applying such $\Delta S_{YKi}$, $\theta S_{MKi}$, and $\Delta S_{CKi}$ to the above Equations (9) to (11), even when the angle of the oblique line patterns is adjusted by the angle adjustment operation and the oblique line patterns of the respective colors have different angles, the position shift amount in the main-scanning direction can be obtained on the basis of the detection result of the oblique line patterns.

As described above, in the optical writing device 111 according to the present embodiment, oblique line patterns having different angles are sequentially formed and detected by the pattern detection sensor 117 as illustrated in FIG. 12, and an optimal pattern angle is determined on the basis of the signal intensity corresponding to a detection signal thereof. Therefore, it is possible to obtain a preferred detection signal without increasing the pattern width in the sub-scanning direction. As a result, it is possible to achieve reduction in toner consumption associated with drawing of the correction pattern for correcting an image forming position and improvement in the accuracy of pattern detection.

The oblique line pattern angle adjusting function according to the present embodiment is particularly effective in the narrow pattern described above with reference to FIG. 9. In the narrow pattern, when position shift in the main-scanning direction occurs, the position in the main-scanning direction of the pattern is shifted relative to a beam spot. As a result, a range of covering the beam spot with the pattern is cut in the main-scanning direction, and the drop amount in the detection signal decreases. Therefore, ensuring the drop amount in the detection signal by aligning the pattern angles is particularly meaningful in the narrow pattern.

However, a decrease in the cover range in a beam spot caused by the difference in angle as described above with reference to FIGS. 11(*b*) and 11(*c*) can occur in the same manner also in the wide pattern as illustrated in FIG. 6. Therefore, the oblique line pattern angle adjusting function according to the present embodiment is effective not only in the narrow pattern, but also in the wide pattern.

The present invention makes it possible to achieve reduction in toner consumption associated with drawing of a correction pattern for correcting an image forming position and improvement in the accuracy of pattern detection.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing control device that controls a light source that exposes a photoconductor to light to form an electrostatic latent image on the photoconductor, the optical writing control device comprising:

a light emission control unit that controls the light source to emit light to expose the photoconductor to light and to form an electrostatic latent image and an electrostatic latent correction pattern;

an optical sensor that detects a correction pattern on a conveying member, the correction pattern having been formed by toner on the conveying member by (a) developing the electrostatic latent correction pattern and (b) transferring the correction pattern from the photoconductor onto the conveying member, the correction pattern having been configured for correcting a transfer position at which a toner image obtained by developing the electrostatic latent image formed on the photoconductor is transferred onto the conveying member and including an oblique line pattern inclined relative to a conveying direction of the conveying member;

a detection signal acquisition unit that acquires a detection signal from the optical sensor that detects the correction pattern formed by the toner on the conveying member;

a correction value calculation unit that calculates, on the basis of the detection signal, a correction value for correcting the transfer position; and an angle adjustment processing unit that determines an angle of the oblique line pattern included in the correction pattern on the basis of a detection signal obtained by detecting an angle adjustment pattern by the optical sensor, the angle adjustment pattern including a plurality of continuous oblique line patterns having different inclinations relative to the conveying direction, wherein the light emission control unit controls the light source to emit light so that a plurality of oblique line patterns having different inclinations relative to the conveying direction are continuously formed to draw the angle adjustment pattern, and controls the light source to emit light so that an oblique line pattern having the determined angle is formed in the correction pattern to draw the correction pattern.

2. The optical writing control device according to claim 1, wherein the angle adjustment processing unit determines, as an angle of the oblique line pattern included in the correction pattern, an angle of an oblique line pattern having the largest detection intensity among detection signals obtained by detecting the angle adjustment pattern by the sensor.

3. The optical writing control device according to claim 2, wherein when there are a plurality of oblique line patterns that are determined to have the largest detection intensity among detection signals obtained by detecting the angle adjustment pattern by the sensor, the angle adjustment processing unit determines, as an angle of the oblique line pattern included in the correction pattern, an angle of an oblique line pattern having the shortest period during which a detection signal detected by the sensor is varying in conveyance of the conveying member.

4. The optical writing control device according to claim 1, wherein the light emission control unit controls the light source to emit light so that a correction pattern having a width corresponding to a detection range of the sensor in a main-scanning direction is drawn to draw the correction pattern.

5. The optical writing control device according to claim 1, wherein the angle adjustment processing unit determines an angle of the oblique line pattern included in the correction pattern on the basis of a detection signal of the angle adjustment pattern that is drawn in a state in which position shift correction is previously performed.

6. The optical writing control device according to claim 5, wherein the correction value calculation unit calculates a first correction value on the basis of a detection signal of the correction pattern that is drawn with a width having a margin with respect to a detection range of the sensor in the main-scanning direction and calculates a second correction value on the basis of a detection signal of a correction pattern that is drawn by applying the calculated first correction value and has a width corresponding to the detection range of the sensor in the main-scanning direction to perform the previous position shift correction.

7. The optical writing control device according to claim 1, wherein the light emission control unit controls the light source to emit light so that a plurality of oblique line patterns having different inclinations within the range of 180° relative to the conveying direction are continuously formed to draw the angle adjustment pattern.

8. An image forming apparatus comprising the optical writing control device according to claim 1.

9. A method for controlling an optical writing device that controls a light source that exposes a photoconductor to light to form an electrostatic latent image on the photoconductor, the method comprising the steps of:

controlling the light source to emit light to expose the photoconductor to light, and to form an electrostatic latent image and an electrostatic latent correction pattern;

detecting a correction pattern on a conveying member with an optical sensor, the correction pattern having been formed by toner on the conveying member upon by (a) developing the electrostatic latent correction pattern and (b) transferring the correction pattern from the photoconductor onto the conveying member, using the correction pattern for correcting a transfer position at which a toner image obtained by developing the electrostatic latent image formed on the photoconductor is transferred onto the conveying member, the correction pattern including an oblique line pattern inclined relative to a conveying direction of the conveying member;

acquiring a detection signal from the optical sensor that detects the correction pattern formed by the toner on the conveying member;

calculating, on the basis of the detection signal, a correction value for correcting the transfer position; and determining an angle of an oblique line pattern included in the correction pattern on the basis of a detection signal obtained by detecting the angle adjustment pattern by the optical sensor, the angle adjustment pattern including a plurality of continuous oblique line patterns having different inclinations relative to the conveying direction.

* * * * *